US012279642B1

(12) United States Patent
Sinclair, Jr.

(10) Patent No.: US 12,279,642 B1
(45) **Date of Patent: *Apr. 22, 2025**

(54) SMOKING PRODUCT AND METHOD OF MAKING

(71) Applicants: Blunt Wrap U.S.A., Inc., Mandeville, LA (US); NORTH ATLANTIC WRAP COMPANY LLC, Louisville, KY (US)

(72) Inventor: Daniel S. Sinclair, Jr., Mandeville, LA (US)

( * ) Notice: Subject to any disclaimer, the term of this patent is extended or adjusted under 35 U.S.C. 154(b) by 1053 days.

This patent is subject to a terminal disclaimer.

(21) Appl. No.: 17/195,761

(22) Filed: Mar. 9, 2021

Related U.S. Application Data

(63) Continuation of application No. 15/972,465, filed on May 7, 2018, now Pat. No. 10,939,700, which is a continuation of application No. 14/835,159, filed on Aug. 25, 2015, now Pat. No. 9,961,935, which is a continuation of application No. 12/388,758, filed on Feb. 19, 2009, now Pat. No. 9,113,658, which is a continuation of application No. 11/139,432, filed on May 27, 2005, now abandoned.

(60) Provisional application No. 60/575,473, filed on May 28, 2004.

(51) Int. Cl.
*A24D 1/02* (2006.01)
*A24C 5/46* (2006.01)

(52) U.S. Cl.
CPC ..... *A24D 1/022* (2013.01); *A24C 5/46* (2013.01); *A24D 1/027* (2013.01)

(58) Field of Classification Search
None
See application file for complete search history.

(56) References Cited

U.S. PATENT DOCUMENTS

| | | | | | |
|---|---|---|---|---|---|
| 191,501 | A | * | 5/1877 | Willis | A24C 1/02 131/77 |
| 200,889 | A | * | 3/1878 | Bishop | A24C 1/02 131/73 |
| 389,975 | A | * | 9/1888 | Riedel | A24C 5/42 131/365 |
| 1,289,975 | A | * | 12/1918 | Waddell | A24C 5/40 131/365 |
| 3,580,433 | A | * | 5/1971 | Kastner | B65B 19/34 222/440 |
| 5,632,287 | A | * | 5/1997 | Hayworth | A24D 1/00 131/365 |
| 5,645,089 | A | * | 7/1997 | Burger | A24C 5/40 131/365 |
| 5,762,074 | A | * | 6/1998 | Garner | A24C 5/40 131/358 |
| 5,782,246 | A | * | 7/1998 | Axelrod | A24D 1/00 131/364 |
| 6,164,443 | A | * | 12/2000 | Mitchell | A24C 5/40 131/365 |

(Continued)

*Primary Examiner* — Michael J Felton
(74) *Attorney, Agent, or Firm* — Roy Kiesel Ford Doody & North, APLC; Brett A. North

(57) ABSTRACT

Provided are materials for making a hand rolled smoking article having a novel sheet. The sheet can include a rectangular portion and an irregular shaped portion. The sheet can be manufactured from tobacco leaf or foil, homogenized tobacco paper, or conventionally available rolling paper. The sheet can be filled with a filler material and rolled to form a cigar or cigarette.

17 Claims, 5 Drawing Sheets

(56) References Cited

U.S. PATENT DOCUMENTS

| | | | | |
|---|---|---|---|---|
| 6,321,755 | B1 * | 11/2001 | Sinclair, Jr. | A24C 5/40 131/73 |
| 6,357,448 | B1 * | 3/2002 | Sinclair, Jr. | A24C 5/40 D27/101 |
| 6,526,986 | B1 * | 3/2003 | Sinclair, Jr. | A24C 5/40 D27/101 |
| 9,113,658 | B1 * | 8/2015 | Sinclair, Jr. | A24D 1/027 |
| 9,961,935 | B1 * | 5/2018 | Sinclair, Jr. | A24D 1/022 |
| 10,939,700 | B1 * | 3/2021 | Sinclair, Jr. | A24C 5/46 |

* cited by examiner

SMOKING PRODUCT AND METHOD OF MAKING

CROSS-REFERENCE TO RELATED APPLICATIONS

This is a continuation of U.S. patent application Ser. No. 15/972,465, filed May 7, 2018 (issued as U.S. Pat. No. 10,939,700 on Mar. 9, 2021), which is a continuation of U.S. patent application Ser. No. 14/835,159, filed Aug. 25, 2015 (issued as U.S. Pat. No. 9,961,935 on May 8, 2018), which is a continuation of U.S. patent application Ser. No. 12/388,758, filed Feb. 19, 2009 (issued as U.S. Pat. No. 9,113,658 on Aug. 25, 2015), which is a continuation of U.S. patent application Ser. No. 11/139,432, filed May 27, 2005, which application claimed priority to U.S. Provisional Patent Application Ser. No. 60/575,473, filed May 28, 2004. Each of the above referenced applications and/or patents are incorporated herein by reference and priority to/of each of the above applications and/or patents is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

Smoking articles with tube-shaped sleeves are generally known as cigars, cigarillos and cigarettes. Cigars generally consist of a tobacco filler material, a surrounding wrapper holding the tobacco filler material together and an exterior cover or wrapper. Generally, machined-manufacture cigars and cigarette are distinguished from hand rolled. Machine manufactured are generally referred to as cigarillos and short cigars and can be produced continuously as strands and cut to length. Cigarettes generally consist of fine tobacco cuttings in a tube-shaped paper sleeve.

Apart from machine manufactured cigarettes, cigarette tobaccos and cigarette papers are available for the smoker to roll his own cigarettes by hand and in some cases with the aid of simple assisting devices. By this means the smoker rolls a portion of the cigarette tobacco in a rectangular cigarette paper and then glues the paper along its lengthwise edge. For such products a long-standing and important question is whether the self-rolled cigarettes provide the individual with smoking pleasure comparable to the ready-made cigarettes in packages and also do they offer considerable price value?

Generally, "hand rolled" items are produced using individual rolling sheets and filler material. Conventionally, rolling sheets or cigarette rolling papers are made from thin, tissue-like paper having a rectangular shape with sides of between one and four inches in length, and usually between 2.5 to 3.5 inches in length. Rolling sheets can also be made from tobacco leaves and/or homogenized tobacco paper.

When using such conventionally shaped cigarette rolling paper to make or roll a cigarette by hand, the paper is first folded, bent or held in somewhat of a V-shape or U-shape with one of the sides of the "V" or "U" being longer than the other. An amount of smoking filler material, such as tobacco or the like, is distributed substantially over the entire length of the rolling paper in the bottom of the V- or U-shaped pouch formed by the rolling paper. The longer portion of the rolling paper, being free of any of the smoking material, is then bent or rolled over the portion of the rolling paper covered with the tobacco and is rolled over upon itself to form a substantially cylindrical shape. The longer end of the rolling paper is wrapped around itself as far as possible and overlaps an underlying layer to form part of the wall of the cylinder.

The rolling process, when performed by hand, requires a keen eye, a steady hand, and a high degree of finger digital dexterity, since the rolling paper is not very large compared to a human hand and fingers, because the particles of smoking filler materials tend to roll or slide off the small rolling paper, and because the rolling paper itself is very thin and easily ripped or torn. A critical step of rolling a cigar or cigarette by hand is using fingers to both form the "V" or "U" shaped pouch for the smoking material, and to roll the longer portion of the rolling paper around itself. During the process of rolling the longer portion of the paper around itself, the user depends on the trapped smoking material to provide the generally cylindrical shape to guide placement of the longer portion around itself to produce a generally cylindrical cigarette.

Oftentimes, however, the use of smoking filler material to guide placement of the longer portion around itself does not aid in producing a cylinder due to either poor distribution of smoking material along the V- or U-shaped pouch, causing the longer portion to be rolled too tight or too loose around itself, with respect to the majority portion of the smoking material, or due simply to the user's inability to correctly manipulate or spiral the cigarette rolling paper around itself between their fingers. The result of either of these situations can be an unsmokable cigar or cigarette or one that falls apart or is torn.

Cigarettes and cigars that are rolled using conventional rolling sheets generally do not permit complete use of the smoking material disposed within because the cigarette and cigar can only be smoked until the lit end approaches the user's fingers or lips during holding or smoking, the cigarette must be dispensed, and at which time a user's fingers or lips may be burned.

It is, therefore, desirable that a rolling sheet be constructed in a manner that assists the user in rolling a cigarette or cigar by hand. It is desirable that the cigarette rolling paper be constructed in a manner that prevents smoking material from being drawn from the cigarette into a smoker's mouth. It is also desirable that the cigarette rolling paper be constructed in a manner that permits the entire smoking material to be smoked without the risk of burned fingers or burned lips. It is further desirable that the cigarette rolling paper be constructed from conventional materials using conventional techniques.

The present invention relates to prepared materials for an article for smoking which is hand rolled by the smoker and includes a sleeve section rolled into a tube-shaped sleeve and a filler made of tobacco.

The following U.S. Patents are incorporated herein by reference: U.S. Pat. No. 6,526,986.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. What is provided in one embodiment is a new sheet for hand rolling cigars and cigarettes. Provided in another embodiment is a method of making a hand rolled cigar or cigarette.

In one embodiment disclosed is a sheet having a substantially rectangular base for receiving a smoking filler material and an irregular shaped wrapper section for wrapping about the rectangular part. The length of the base portion can determine the length of the cigar or cigarette created by hand rolling the sheet.

In various embodiments different shaped wrapper portions are disclosed.

Smokers can more easily hand roll custom cigars and cigarettes without the finger dexterity demanded by prior systems. Custom rolled cigar and cigarette stability can be achieved through an irregularly shaped portion of the rolling sheet. This prevents the intake of "false air" and guarantees smooth burning during smoking of the custom rolled cigar or cigarette.

The invention additionally makes possible the individual, pure tobacco smoking of self rolled smoking articles. From combinations of tobacco types dictated for the sleeve section and for the filler, the smoker selects and varies the desired aroma and obtains the sought after repeatability better than through mixing various types of tobacco in the filler alone. If desired a simple assisting device can also be employed (similar to those used with cigarette rolling); however, the rolling is accomplished free hand without more, that is, without support.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
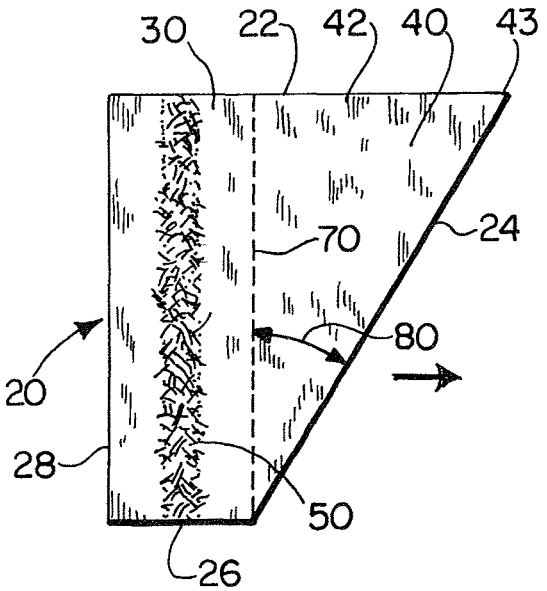
FIG. 1 shows a sheet having an irregularly shaped portion.
Figure 2:
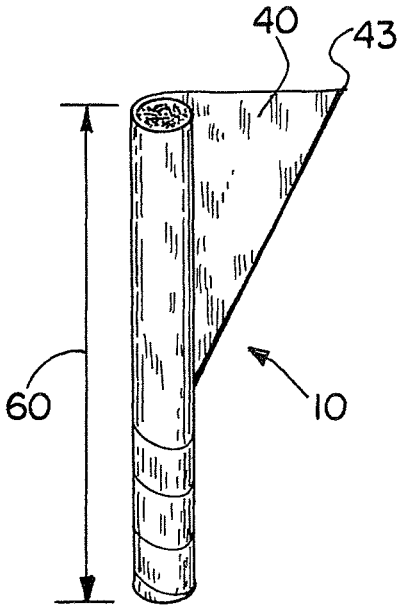
FIG. 2 shows the sheet of FIG. 1 partially rolled.
Figure 3:
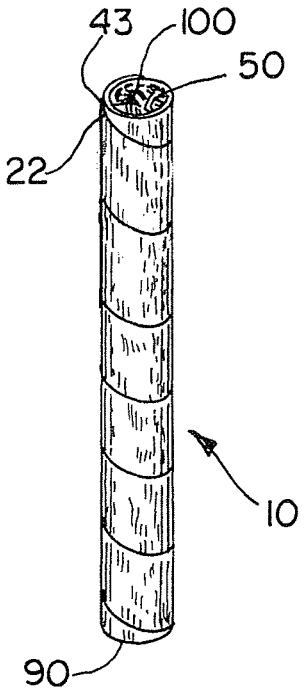
FIG. 3 shows a finished smoking article prepared from the sheet of FIG. 1.

The procedure of "hand rolling" a smoking article 10 is shown in FIGS. 1 and 2. Sheet 20 can comprise sides 22, 24, 26, and 28. Sheet 20 can includes a rectangular portion 30 (sides 26 and 28) and an irregular shaped portion 40 (side 24 and portion 42).

Angle 80 is preferably an acute angle; angle 80 preferably ranges between 15 and 75 degrees, more preferably between 25 and 60 degrees, and most preferably between 30 and 45 degrees.

The person custom rolling his cigar can spread smoking filler material 50, such as tobacco filler material, on rectangular portion 30. Then he begins to roll filler material 50 on rectangular portion 30 into a cylindrical form that can be accomplished freehand between the fingers of both hands. With continued rolling irregular shaped portion 40 also overlies filler material 50 placed in rectangular portion 30. Through such process sheet 20 can rolled into a tube shaped cigar or cigarette smoking article 10.

When finished the area adjacent to side 22 in rolled article 10 forms mouthpiece end of article 10. Smoking article 10 can be held together without mechanical fasteners or adhesives by users gripping point 43. However, adhesives or mechanical fasteners can be used if desired. End 90 can be used to light smoking article 10. Irregularly shaped portion 40 can provide stability during rolling and during smoking.

The overall length 60 of smoking article 10 will generally be equal to length 35 of rectangular portion 30. Width 36 of rectangular portion 30 can generally correspond to the circumference 70 of smoking article 10. However, circumference 70 can vary with rolling according to the amounts of filler and its density. For example, rectangular portion 30 can be rolled onto itself during the above described rolling process.

Generally, it is preferred that a length 35 of approximately 60-100 mm and a width 36 of of approximately 25-35 or 40 mm is found to produce smoking article 10.

In an alternative embodiment rolling of smoking filler material 50 simultaneously with a filter tip 85 (not illustrated) can be performed.

Figure 4:
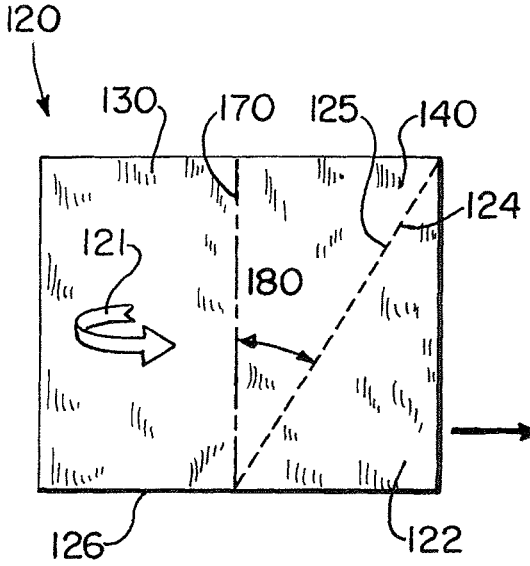
FIG. 4 shows an alternative embodiment for a sheet.
Figure 5:
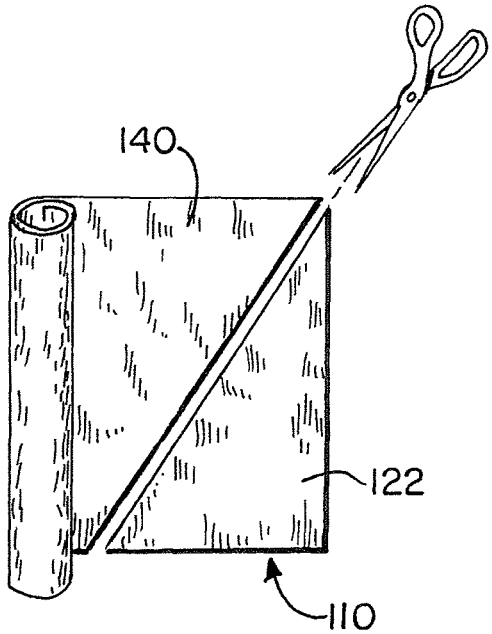
FIG. 5 shows the sheet of FIG. 4 showing a section being removed.

FIGS. 4 and 5 illustrate an alternative embodiment showing sheet 120 formed from a rectangular sheet. Sheet 120 can include perforated line 125. Perforated line 125 allows the user the option of converting sheet 120 into a sheet having an irregularly shaped portion by removing section 122. Section 122 can be removed by tearing or cutting such as by a scissors. Perforated line 125 can also be a non-perforated line wherein the user would most likely be required to cut sheet 120 to create irregularly shaped portion 140 by removing section 122. Sheet 120 can be rolled in the same manner as described above for sheet 20 to form smoking article 110.

Figure 6:
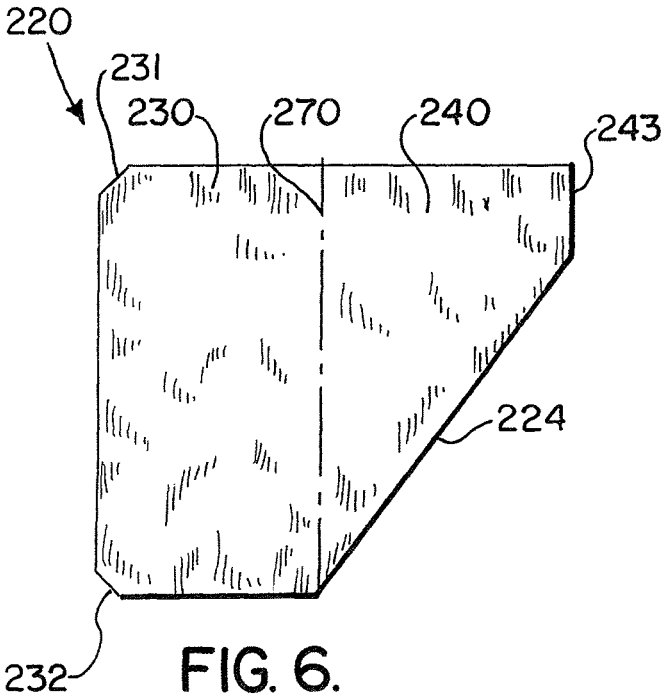
FIG. 6 shows an alternative embodiment for a sheet.
Figure 7:
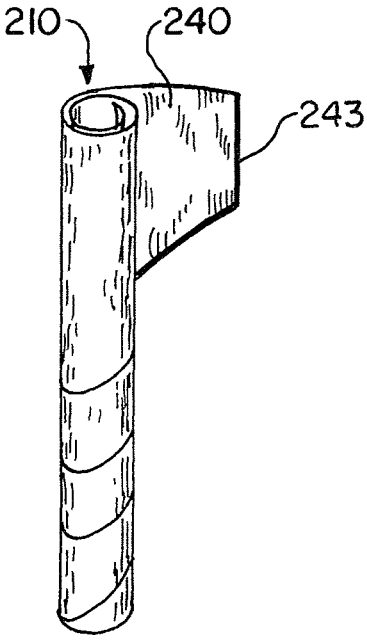
FIG. 7 shows the sheet of FIG. 6 partially rolled.

FIGS. 6 and 7 illustrate another alternative embodiment showing sheet 220. In this embodiment irregularly shaped portion 240 can be trapezoidal in shape. Rectangular portion 230 can include cut corners 231 and 232 which can facilitate rolling of smoking article 210. Cut corners 231 and 232 can also facilitate proper placement of smoking filler material 50. Sheet 220 can be rolled in the same manner as described above for sheet 20 to form smoking article 210.

Figure 8:
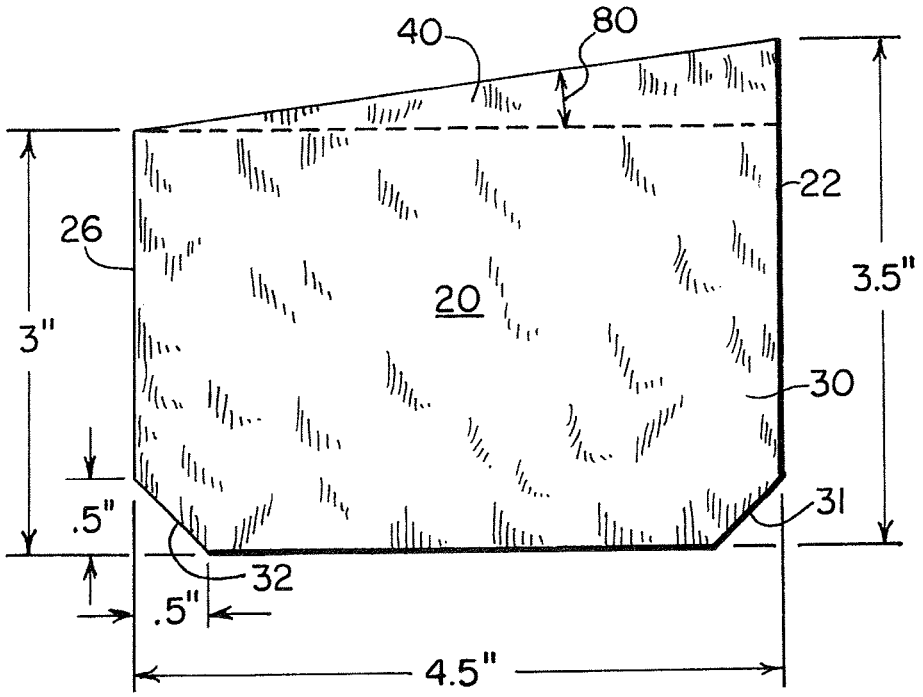
FIG. 8 shows a sheet having a plurality of cut corners.
Figure 9:
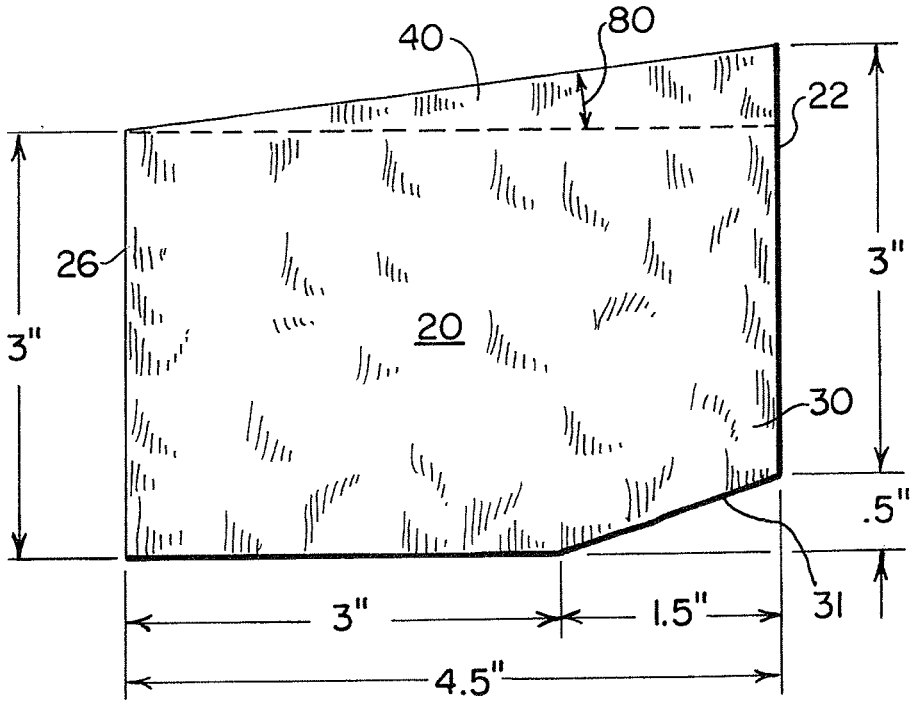
FIG. 9 shows a sheet having one cut corner.

FIGS. 8 and 9 illustrate alternative embodiments for sheet 20 having one or two cut corners. FIG. 8 shows two cut corners 31 and 32 which were cut at an approximately angle of 45 degrees. The angles of cut can vary from each other. FIG. 9 shows a single cut corner which was cut at an approximate angle of 30 degrees. Cut 31 tends to force the user to place smoking filler material spaced from side 22 of sheet 20. Accordingly, when rolled smoking filler material 50 will be spaced away from mouthpiece 100 of smoking article 20. As with other embodiments cuts 31 and 32 can be optionally included in sheet 10 through lines or perforated lines.

Figure 10:
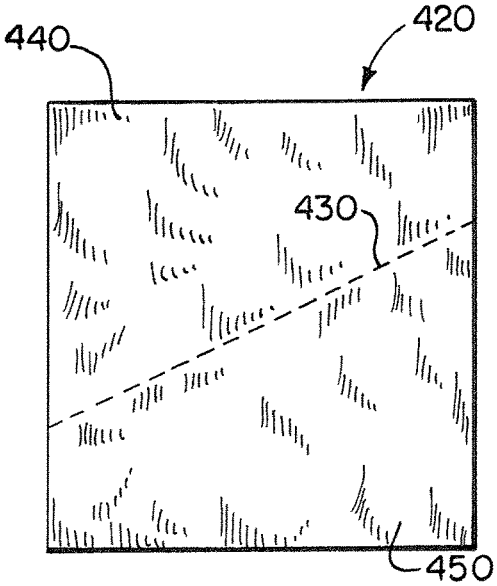
FIG. 10 shows an alternative embodiment for a sheet.
Figure 11:
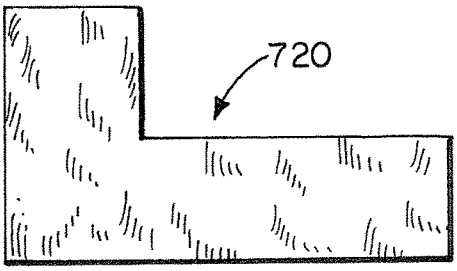
FIGS. 11 through 15 illustrate various alternative embodiments for sheets.
Figure 12:
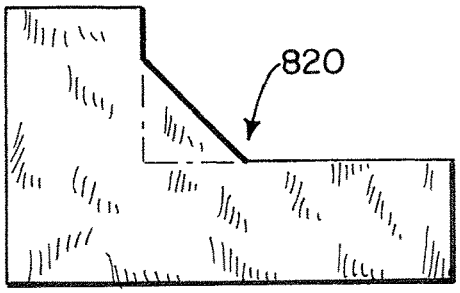
Figure 13:
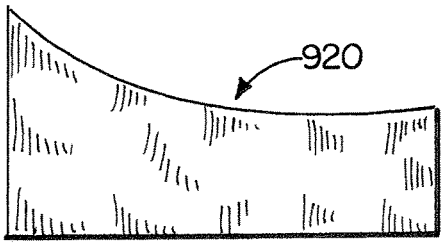
Figure 14:
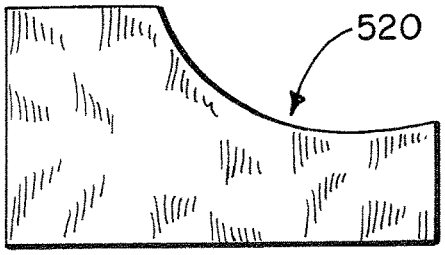
Figure 15:
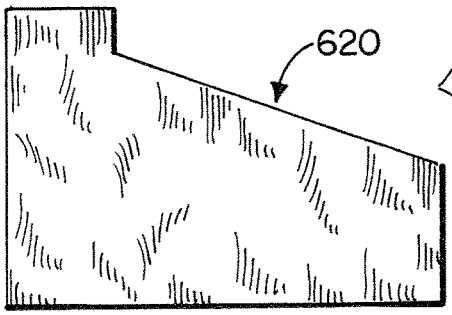

FIG. 10 shows an alternative embodiment for sheet 420 which can be used to make two sheets for creating two smoking articles 10. Sheet 420 can comprise perforated line 43 which can split sheet 420 into sheets 440 and 450 each having irregularly shaped portions.

FIGS. 11 through 15 show various alternative embodiments for sheets 520, 520, 720, 820, 920 having irregularly shaped portions. As illustrated above such sheets can be preformed or created by the user from perforations or lines. As illustrated above such sheets can have one or more cuts on the rectangular portions.

Figure 16:
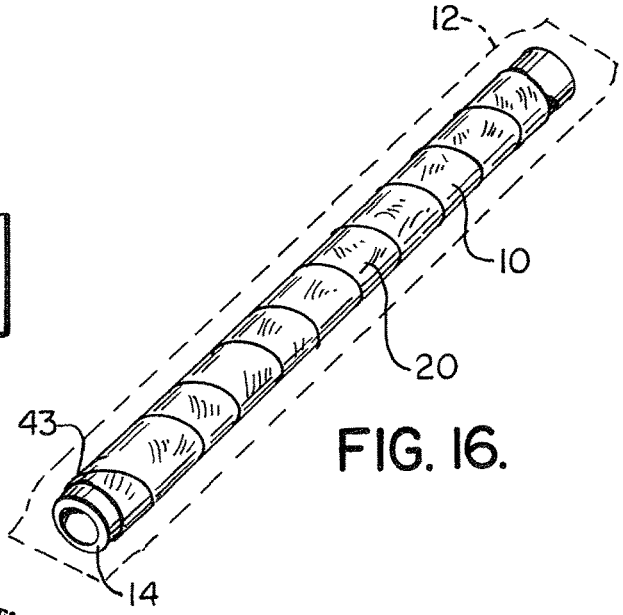
FIG. 16 is a perspective view of a sheet with a gripping point wrapped around a mandrel and in a package.

FIG. 16 is a perspective view of a sheet 20 with a gripping point 43 wrapped around a mandrel 14 and in a package 12.

Figure 17:
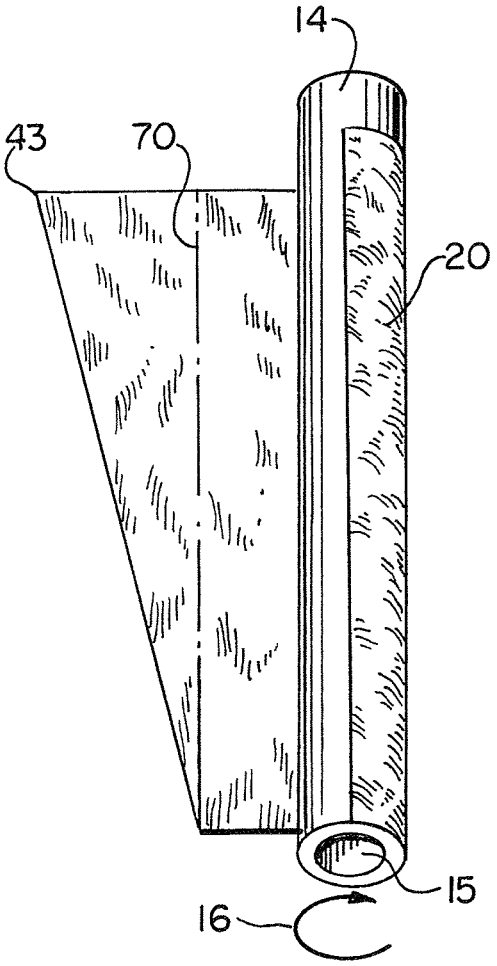
FIGS. 17 through 18 illustrate an alternative embodiment where a sheet is rolled on a mandrel and packaged for sale in an unfilled condition.
Figure 18:
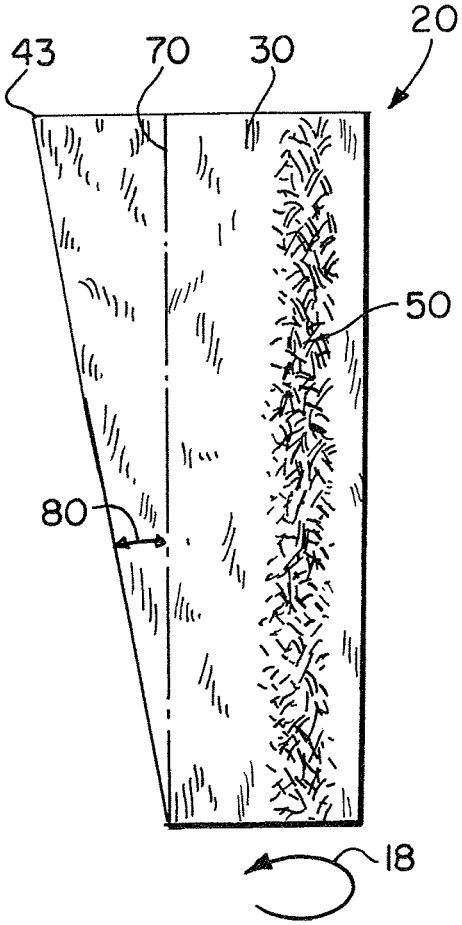

FIGS. 17 through 18 illustrate an alternative embodiment where sheet 20 is rolled on a mandrel 14 and packaged in packaging 12 for sale in an unfilled condition. When packaged smoking filler material 50 can be omitted or used to partially fill the interior bore 15 of mandrel 14. Sheet 20 and mandrel 14 are removed from packaging 12. Sheet 20 is unrolled from mandrel 14 in the direction of arrow 16. When unrolled sheet 20 will tend to have a memory tending to cause sheet 20 to roll back in the direction of arrow 18. Smoking filler material 50 is added and sheet 20 is rolled in the direction of arrow 18 to form a smoking article 10. The memory in sheet 20 will assist the user in rolling sheet 20.

Figure 19:
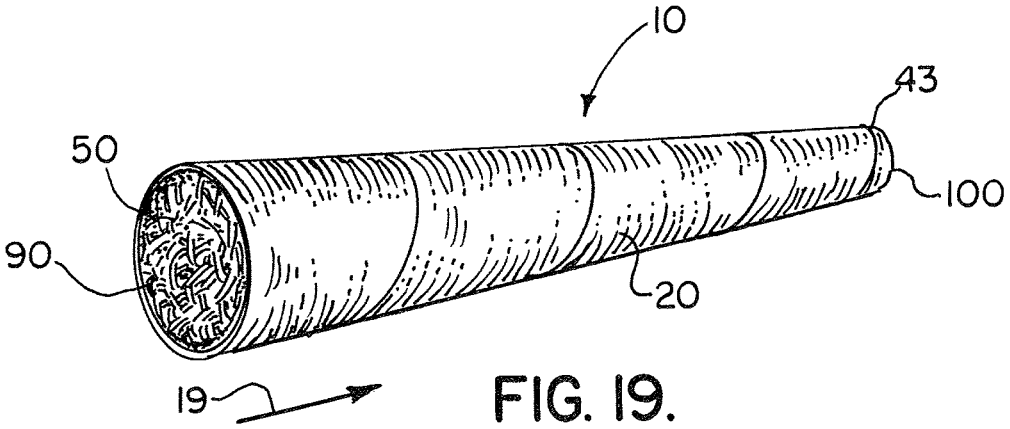
FIG. 19 illustrates an alternative embodiment where finished smoking article is rolled in a tapered fashion.

FIG. 19 illustrates an alternative embodiment where finished smoking article 10 is rolled in a tapered fashion. Any of the various embodiments for sheet 20 can be used to create the tapered rolled smoking article 10. A tapered smoking article 10 has the advantage of decreasing the amount of smoking filler material 50 burned when as article 10 is burned in the direction of arrow 19. Such decreasing volume of smoking filler material tends to even the flavor of the filler material as residue from earlier burned filler material is deposited in the unburned filler material as the article is burned in the direction of arrow 19.

The following is a list of reference numerals:

LIST FOR REFERENCE NUMERALS

| (Reference No.) | (Description) |
|---|---|
| 10 | smoking article |
| 12 | package |
| 14 | mandrel |
| 15 | bore |
| 16 | arrow |
| 18 | arrow |
| 19 | arrow |
| 20 | sheet |

-continued

LIST FOR REFERENCE NUMERALS

| (Reference No.) | (Description) |
|---|---|
| 22 | side |
| 24 | side |
| 26 | side |
| 28 | side |
| 30 | rectangular portion |
| 31 | corner |
| 32 | corner |
| 35 | length |
| 36 | width |
| 40 | irregularly shaped portion |
| 43 | gripping point |
| 50 | filler material |
| 60 | length |
| 70 | circumference |
| 80 | angle |
| 85 | tip |
| 90 | end |
| 100 | mouth end |
| 110 | smoking article |
| 120 | sheet |
| 121 | arrow |
| 122 | section |
| 124 | perforations |
| 125 | line |
| 126 | side |
| 130 | rectangular portion |
| 140 | irregularly shaped portion |
| 170 | line |
| 180 | angle |
| 210 | smoking article |
| 220 | sheet |
| 230 | rectangular portion |
| 231 | corner |
| 232 | corner |
| 240 | irregularly shaped portion |
| 243 | tab |
| 270 | line |
| 320 | sheet |
| 420 | sheet |
| 430 | line |
| 440 | sheet |
| 450 | sheet |
| 520 | sheet |
| 620 | sheet |
| 720 | sheet |
| 820 | sheet |
| 920 | sheet |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented byway of example only; the scope of the present invention is to be limited only by the following claims.

The invention claimed is:

1. A smoking article, comprising:

(a) a sheet of combustible material;

(b) a perforation that divides the sheet into first and second sections;

(c) the first section being a generally parallelogram section;

(d) the second section being attached to the parallelogram section on one of the sides via the dividing perforation with the second section extending the entire length of the attached side, the second section being not a parallelogram;

(e) the first section defining a section that can be rolled into a tube; and (f) a smokable filler that fills the tube.

2. The smoking article of claim 1, wherein the second section has an edge that is in the shape of a part of an ellipse.

3. The smoking article of claim 1, wherein the second section has an edge that is in the shape of a part of a circle.

4. A smoking article, comprising:

(a) a sheet of material having a plurality of sides and a perforated line that extends from one of the sides to another of the sides, (b) the perforated line separating the sheet into first and second sections;

(c) wherein each of the sections can be rolled into a tube having a diameter sufficiently large to hold a user's smokable filler material;

(d) wherein one of the sections has two sides that form an angle; and (e) a smokable filler that fills a selected one of the tubes.

5. The smoking article of claim 4, wherein the sections include a parallelogram section.

6. The smoking article of claim 4, wherein one of the sections is in the shape of a triangle.

7. The smoking article of claim 4, further comprising additional perforated lines facilitating the creation of one or more cut corners on the sheet.

8. The smoking article of claim 4, wherein the perforated line has a semicircular shaped portion.

9. The smoking article of claim 8, wherein the sheet includes first and second ends, and the semicircular shaped portion extends from the first to the second end.

10. The smoking article of claim 8, wherein the sheet includes first and second ends, and the semicircular shaped portion does not extend from the first to the second end.

11. The smoking article of claim 8, wherein the sheet includes first and second ends, and the semicircular portion contacts the first end but does not contact the second end.

12. A smoking article, comprising:

a) a sheet of material having multiple sides;

b) a perforated line that extends from a first side to another side generally opposite the first side;

c) the perforation enabling the sheet of material to be separated into first and second sections by separating at the perforated line;

d) the first section having a generally parallelogram shape and defining a section that can be rolled into a tube, the tube having a diameter sufficiently large to hold a user's smokable filler material;

e) the second section being of a shape that is not a parallelogram, having two sides that form an acute angle; and f) a smokable filler that fills the tube.

13. The smoking article of claim 12, wherein the second section is generally triangular in shape.

14. The smoking article of claim 12, wherein the second section is generally trapezoidal in shape.

15. The smoking article of claim 12, wherein one of the sections has one or more cut corners.

16. The smoking article of claim 12, wherein one of the sections has one or more corners and one or more additional perforated lines positioned next to the corners that enable the formation of one or more cut corners.

17. The smoking article of claim 12, wherein the perforated line extends from the first side to another side generally opposite the first side and generally parallel to the first side.

* * * * *